US011684101B2

(12) United States Patent
Kim

(10) Patent No.: US 11,684,101 B2
(45) Date of Patent: Jun. 27, 2023

(54) GARMENT HAVING SHAPE-TRANSFORMABLE COLLAR

(71) Applicant: Min Sik Kim, Seoul (KR)

(72) Inventor: Min Sik Kim, Seoul (KR)

( * ) Notice: Subject to any disclaimer, the term of this patent is extended or adjusted under 35 U.S.C. 154(b) by 86 days.

(21) Appl. No.: 17/615,486

(22) PCT Filed: May 15, 2020

(86) PCT No.: PCT/KR2020/006468
§ 371 (c)(1),
(2) Date: Dec. 7, 2021

(87) PCT Pub. No.: WO2020/242104
PCT Pub. Date: Dec. 3, 2020

(65) Prior Publication Data

US 2022/0232914 A1 Jul. 28, 2022

(30) Foreign Application Priority Data

May 30, 2019 (KR) ..... 10-2019-0064138

(51) Int. Cl.
*A41D 27/18* (2006.01)
*A41B 3/00* (2006.01)

(52) U.S. Cl.
CPC ..... *A41D 27/18* (2013.01); *A41B 3/00* (2013.01)

(58) Field of Classification Search
CPC .. A41B 3/00; A41B 3/005; A41B 5/00; A41B 1/12; A41B 3/04; A41B 3/06;
(Continued)

(56) References Cited

U.S. PATENT DOCUMENTS 161,110 A * 3/1875 Fisk ..... A41B 3/00 2/116
606,859 A * 7/1898 Fenwick ..... A41B 3/00 2/129

(Continued)

FOREIGN PATENT DOCUMENTS

GB 618004 A * 2/1949
JP 2009-013507 A 1/2009

(Continued)

OTHER PUBLICATIONS

KR Office Action dated Aug. 1, 2019 as received in Application No. 10-2019-0064138.

(Continued)

*Primary Examiner* — Amy Vanatta
(74) *Attorney, Agent, or Firm* — Maschoff Brennan

(57) ABSTRACT

The present invention relates to a garment. More specifically, a garment having a shape-transformable collar according to an embodiment of the present invention may comprise a body part and a collar, wherein the collar includes an upper collar and a collar band, and the upper collar and the collar band are formed to have different shapes, so as to enable transformation into various collar shapes through mutually corresponding coupling between a linear portion and a curved portion thereof. In particular, the curved portions of the upper collar and the collar band are formed to have different curvatures. However, the upper collar and the collar band are coupled to correspond to each other, so that the shape of the collar is stably maintained even when the collar is erected or laid down, whereby the present invention can have a fine appearance and also provide an excellent cold weather protection effect.

5 Claims, 5 Drawing Sheets

(58) Field of Classification Search
CPC .... A41B 3/08; A41B 3/12; A41B 1/14; A41B 1/16; A41D 27/18; A41D 1/18
USPC ..... 2/131, 143
See application file for complete search history.

(56) References Cited

U.S. PATENT DOCUMENTS 1,513,700 A * 10/1924 Feigenbaum ..... A41B 1/12 2/127
2,286,510 A * 6/1942 Rubinstein ..... A41B 3/00 2/131
2,289,479 A * 7/1942 Bryant ..... A41B 3/00 2/131
2,344,204 A * 3/1944 Doumaux ..... A41B 3/00 2/116
2,418,058 A * 3/1947 Touloumis ..... A41B 3/00 2/131
2,741,771 A * 4/1956 Bihaly ..... A41B 3/00 D2/602
3,114,152 A * 12/1963 Blue ..... A41B 1/14 2/127
3,363,263 A * 1/1968 Blue ..... A41B 1/00 2/116
3,488,775 A * 1/1970 Dickenherr ..... A41D 27/18 2/98
3,629,866 A * 12/1971 Blue ..... A41B 1/12 2/132

FOREIGN PATENT DOCUMENTS

KR 10-2009-0050703 A 5/2009
KR 10-1358964 B1 2/2014
KR 10-1361974 B1 2/2014
KR 10-2019-0064138 A 6/2019
KR 10-2034412 B1 10/2019

OTHER PUBLICATIONS

KR Decision to Grant dated Oct. 8, 2019 as received in Application No. 10-2019-0064138.

* cited by examiner

[FIG. 1]
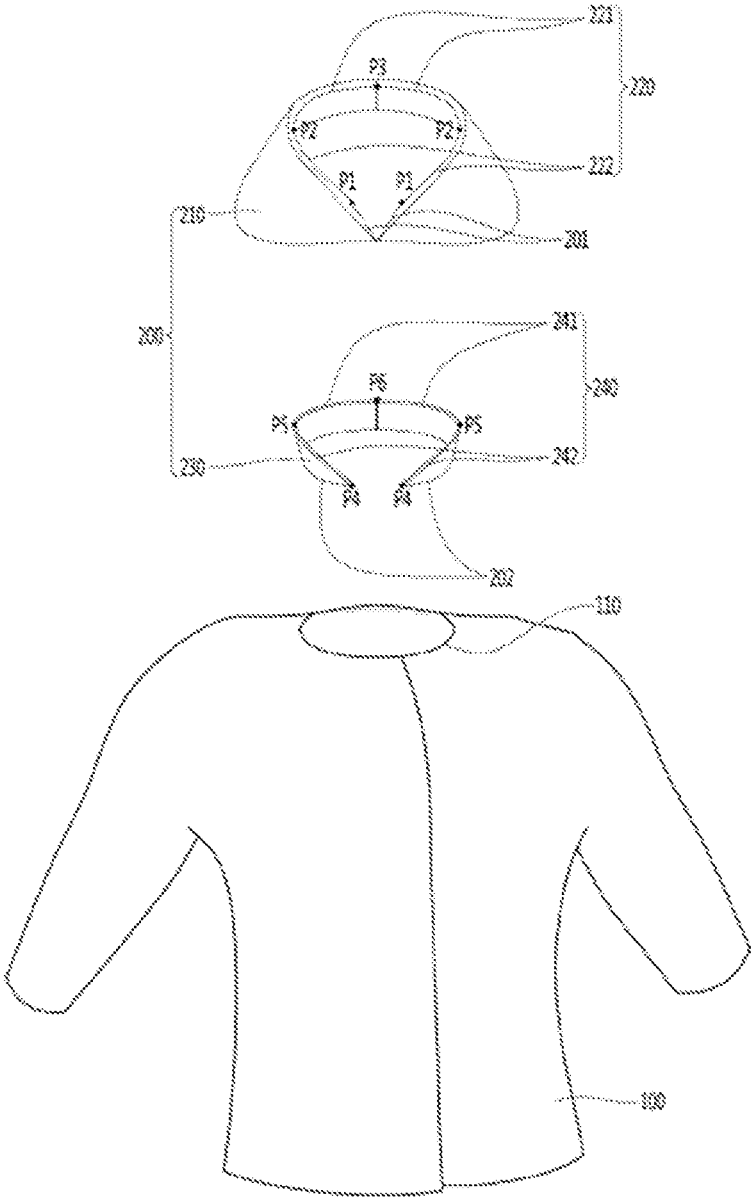

[FIG. 2]
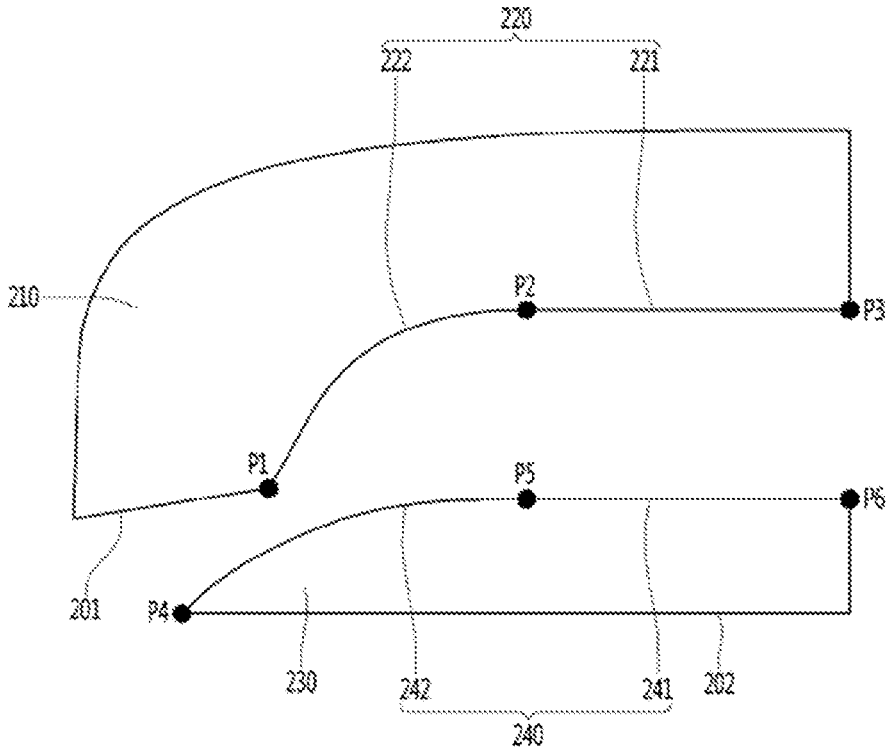
[FIG. 3a]
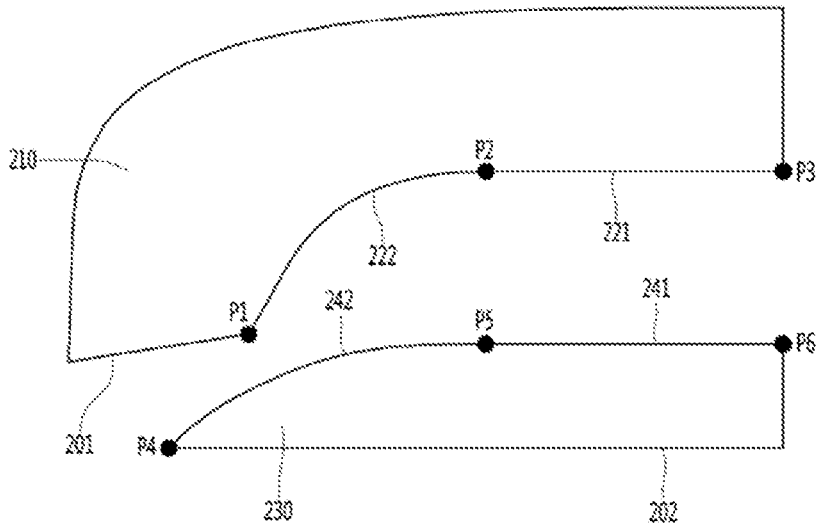

[FIG. 3b]
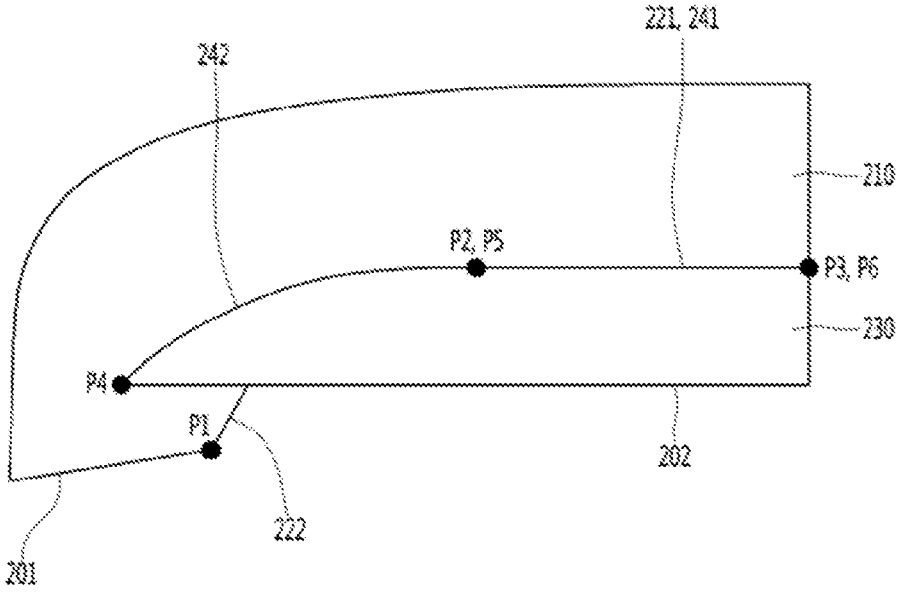
[FIG. 3c]
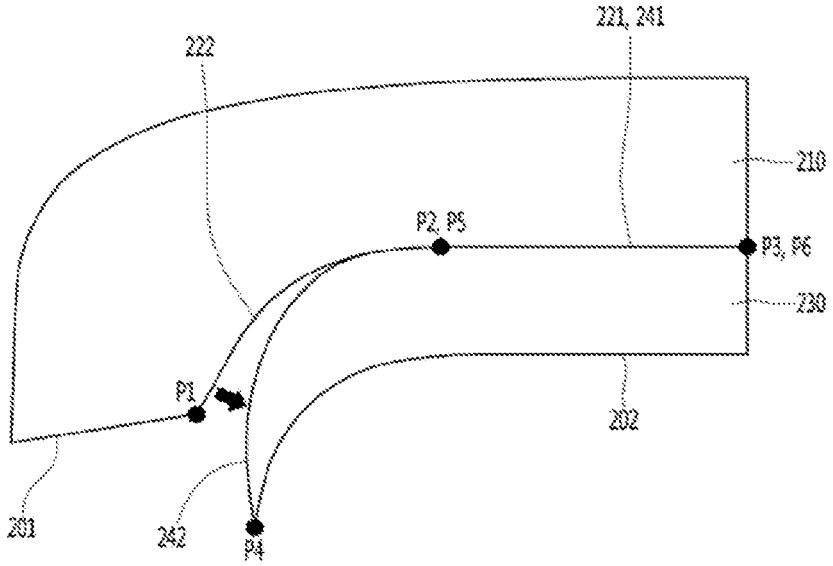

[FIG. 3d]
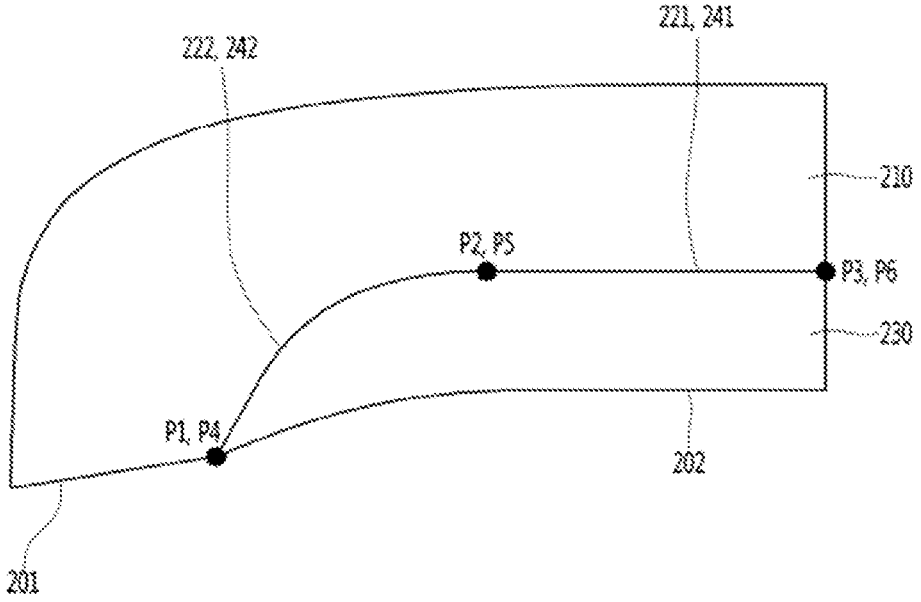

[FIG. 4]
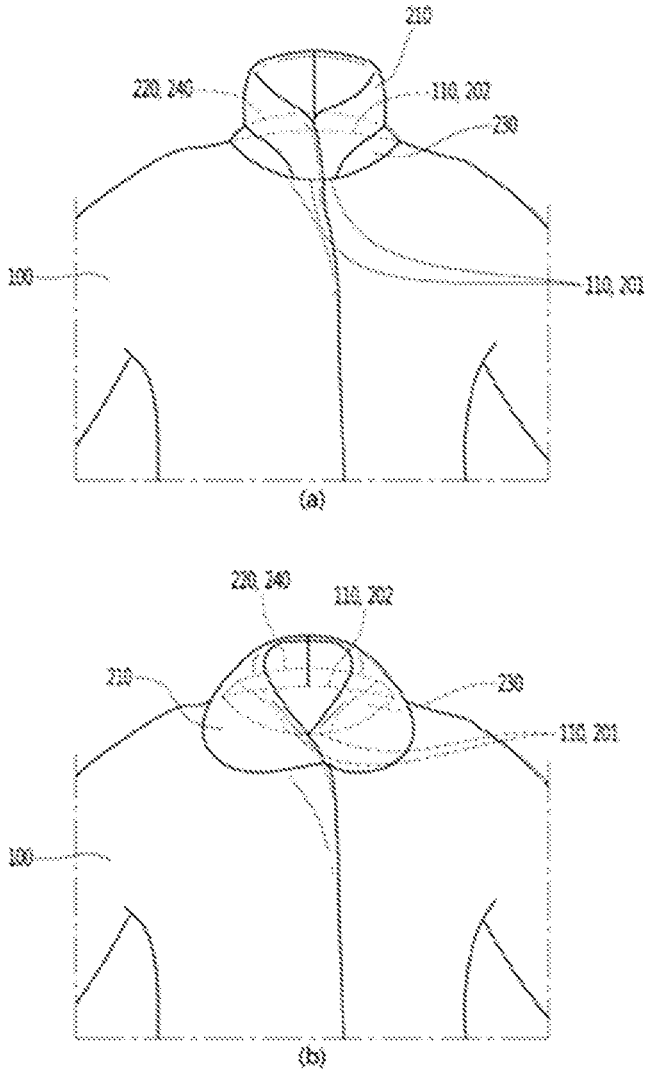

GARMENT HAVING SHAPE-TRANSFORMABLE COLLAR

FIELD OF INVENTION

The present invention relates to a garment, and more particularly to a garment for improving a collar structure of a garment to modify a shape of the collar in various ways, achieving beautiful appearance, and stably maintaining the shape of the collar.

This application claims priority to and the benefit of Korean Patent Application No. 10-2019-0064138, filed on May 30, 2019, the disclosure of which is incorporated herein by reference in its entirety.

BACKGROUND OF INVENTION

In general, a collar of a garment is a part wrapped around the neck, most commonly refers to a part applied to the top or shirt of a suit, and is widely applied to various garments such as jackets and coats made of relatively thick fabrics.

There are various types of collars depending on the shape, and thus when a consumer purchases a garment, the shape of the collar is considered as an important factor. Depending on the size or shape of the collar, the collar has a considerable effect on the appearance of clothes when worn, and for example, the upper body looks long, the face looks big, and the length of the neck looks long or short, and thus it is desirable for a garment manufacturer to consider the shape of the collar to emphasize a physical advantage of a consumer and to supplement a disadvantage of the consumer.

In addition, as the collar itself is a single design, the collar is used to pursue various styles. However, when a consumer purchases a garment with a specific type of collar once and then wants a different style, the consumer needs to disadvantageously purchase a garment with a different type of collar again. There is a problem in that the more expensive garments, the greater a burden on consumers. For example, this is even true for fur garments made using expensive fabrics such as mustang and mink.

Since fur garments require a large amount of animal hides for production thereof, the price of the finished product is quite high, and due to the characteristics of the fur garment, automation and mechanization are impossible, and thus the fur garment is made manually by people with skilled technology and experience, and there is a lot of price difference depending on a work method.

In addition, to make a part that requires a delicate structure and external expression such as collar, more skilled technology is required. In particular, in order to realize a cold protection function as the largest advantage of the fur garment, to the maximum, the structure of the neck line and collar of the fur garment are important.

In general, fur garments constitute a "V" shape of the neck line to reduce neck tightness. Thus, beauty is pursued in terms of a design, but there is a problem that the neck is exposed a lot, and thus a "V" shape is not suitable to block cold.

For example, in the case of a stand collar type fur garment, when a neck line is formed high to match a neck circumference of a wearer, the height of the collar is excessively increased compared with the height of the wearer's neck, which touches the jawline of the wearer and causes discomfort due to a material.

When the height of the collar is lowered to reduce this discomfort, a problem in terms of the appearance of the fur garment occurs, and thus it is common to form a neck line in a "V" shape below the collarbone.

It is difficult for the fur garment to stably maintain the form of a collar positioned upright without a collar coupling element, and thus there is a problem in that it is difficult to realize various designs in the case of garments made of mustang, and for example, an external coupling element such as a band needs to be added.

Thus, in order to overcome the aforementioned problems, there is a need for technology for achieving beautiful appearance of a garment while changing the shape of a collar in various ways by improving the structure of the collar of the garment and stably maintaining the shape of the collar even if the collar is positioned upright or is laid flat.

The aforementioned background art is technological information that the inventor possesses for derivation of the present invention or acquires during derivation of the present invention, and it may not be said that it is necessarily a known technology disclosed to the general public before the filing of the present invention.

SUMMARY OF INVENTION

Technical Problem to be Solved

An embodiment of the present invention may provide a garment having a shape-transformable collar.

An embodiment of the present invention may provide a garment for modifying a shape of the collar in various ways, achieving beautiful appearance, and stably maintaining the shape of the collar.

An embodiment of the present invention may provide a garment having an excellent cold protection function by forming a collar to correspond to the size of the neck of the wearer.

Technical Solution

Therefore, the present invention provides a garment having a shape-transformable collar including a trunk part for surrounding a body of a wearer, and a collar coupled to the trunk part along a neck circumference seam of the trunk part, wherein the collar includes an upper collar formed by coupling a plurality of fabric pieces and forming an outer appearance of the collar, and a collar band coupled between the upper collar and the trunk part, wherein the upper collar includes a first straight portion corresponding to a back of a neck of the wearer, and a first curved portion corresponding to a front of the neck of the wearer and connected to the first straight portion, wherein the collar band includes a second straight portion of the back of the neck of the wearer, and a second curved portion corresponding to the front of the neck of the wearer and connected to the second straight portion, and wherein the first straight portion and the second straight portion are coupled to and correspond to each other, and the first curved portion and the second curved portion have different curvatures and are coupled to and correspond to each other.

The first curved portion may have a higher curvature than the second curved portion.

When the upper collar positioned upright, the upper collar may be maintained in an upright state by coupling the first curved portion and the second curved portion.

The collar bend may always be maintained in the upright state along a neck circumference of the wearer, may have a constant width up to a starting point of the second curved portion, and. may be maintained in a Chinese collar form.

The collar may be coupled to the trunk part along the neck circumference seam of the trunk part, the upper collar may include a first collar seam spaced. apart from the first straight portion and connected to the first curved portion, the collar band may include a second collar seam positioned in parallel to the second straight portion, connected to the second curved portion, and constituting a base line of the collar band, and when the upper collar and the collar band are coupled to each other, the first collar seam and the second collar seam may be connected to each other and may be coupled to the trunk part along the first collar seam and the second collar seam.

The first collar seam and the second collar seam may he formed in an arc shape to correspond to a neck circumference of the wearer.

A height of the collar to an upper end of the upper collar from the second collar seam may correspond to a height of the neck of the wearer.

Effect of Invention

Overcome the above problems, the present invention provides a garment having a shape-transformable collar for changing the shape of a collar in various ways by improving the configuration of the collar.

Overcome the above problems, the present invention provides a garment having a shape-transformable collar for achieving beautiful appearance and stably maintaining the shape of the collar even if the collar is positioned upright and is laid flat.

Overcome the above problems, the present invention provides a garment having a shape-transformable collar for forming a collar to correspond to the size of the neck of the wearer and achieving an excellent cold protection effect.

It will be appreciated by persons skilled in the art that the effects that could be achieved with the present invention are not limited to what has been particularly described hereinabove and other advantages of the present invention will be more clearly understood from the above detailed description.

BRIEF DESCRIPTION OF DRAWINGS

FIG. 1 is an exploded perspective view of a garment according to an embodiment of the present invention.

FIG. 2 is an exploded view showing the configuration of a collar of a garment according to an embodiment of the present invention.

FIGS. 3A to 3D are process diagrams showing a coupling procedure of a collar of a garment according to an embodiment of the present invention.

FIG. 4 is a perspective view showing the state in which a collar of a garment is used according to an embodiment of the present invention.

BEST MODE

Exemplary embodiments of the present invention are described in detail so as for those of ordinary skill in the art to easily implement the present invention with reference to the accompanying drawings. However, the present invention may be implemented in various different forms and is not limited to these embodiments. To clearly describe the present invention, a part without concerning to the description is omitted in the drawings, and like reference numerals in the specification denote like elements.

Reference will now be made in detail to the exemplary embodiments of the present invention with reference to the accompanying drawings.

FIG. 1 is an exploded perspective view of a garment according to an embodiment of the present, invention.

Referring to FIG. 1, a garment 10 may include a trunk part 100 and a collar 200. However, the garment 10 may include a greater number of components than those shown in FIG. 1.

The present invention relates to a garment having a shape-transformable collar and a material thereof may include one or more of cotton, wool, polyamide, polyester, denim, fur, leather, artificial fur, and artificial leather. However, the material is not particularly limited, and a mixture of natural materials and chemical fiber materials may be used.

The garment having a shape-transformable collar according to the present invention may be a garment that uses relatively thick fabric and is difficult to manufacture. In detail, the garment having a shape-transformable collar according to the present may be a coat or a jacket, which is manufactured using fur such as mink or mustang or leather. In the present invention, for convenience of description, an example in which the garment is a fur coat will be described.

According to an embodiment of the present invention, the garment 10 may include the trunk part 100 and the collar 200. The collar 200 may include an upper collar 210 and a collar band 230. The trunk part 100 may be configured by coupling a front part and a back part to surround the body of a wearer and may include a sleeve part coupled to the trunk part 100 to surround the arms of the wearer.

The front part may be a front side of the trunk of the wearer and. may be configured. to cover the front side of the trunk of the wearer, such as the chest and belly of the wearer, based on the side of the wearer.

The back part may be a back side of the trunk of the wearer and may be configured to cover the back side of the trunk of the wearer, such as the back of the wearer, based on the side of the wearer.

The sleeve part may be coupled to the front part and the back part of the trunk and may be configured to cover the arm of the wearer based on the side of the wearer.

The front part, the back part, and the sleeve part of the trunk part 100 may be configured in consideration of the gender, the body size, the body type, etc. of the wearer.

According to an embodiment of the present invention, the trunk part 100 may include a neck circumference seam 110 formed along a neck circumference of the wearer. The neck circumference seam 110 may be a part coupled to the collar 200, and a neck line of the garment 10 may be formed in various forms through. the neck circumference seam 110. For example, the neck line may be formed in a "V" or "U" shape, or the neck. line may be formed to correspond to the neck circumference of the wearer. The present invention will be described in terms of the garment 10 that is manufactured to match the neck circumference seam 110 with the neck of the wearer.

The neck circumference seam 110 may be formed in such a way that left and right sides thereof are symmetrical with respect to the center of the wearer's cervical vertebrae and may be formed in an arc shape along the nape of the neck, shoulder, and collarbone of the wearer.

The collar 200 may be configured to surround the neck of the wearer and may include the upper collar 210 and the collar band 230. The collar 200 may be formed by coupling the upper collar 210 and the collar band 230. The collar 200 may be coupled to the neck circumference seam 110 of the trunk part 100, and a first collar seam 201 of the upper collar 210 and a second collar seam 202 of the collar band 230 may be coupled to the neck. circumference seam 110 of the trunk part 100. In this case, the first collar seam 201 and the second collar seam 202 may be formed in an arc shape to correspond to the neck circumference of the wearer like the neck circumference seam 110.

The upper collar 210 may form an outer appearance of the collar 200, and may include the first collar seam 201 coupled to the neck circumference seam 110 of the trunk part 100 and an upper collar seam. 220 coupled to the collar band 230. When the upper collar 210 is coupled to the collar band 230, the first collar seam. 201 may be connected to the second collar seam 202 of the collar band. 230 and may be coupled to the neck circumference seam 110. The upper collar seam 220 may be a seam in which the upper collar 210 is coupled to the collar band 230, may be formed along lower end of the upper collar 210, and may be formed to correspond to the neck circumference of the wearer. The first collar seam 201 and the upper collar seam 220 will be described in detail with reference to FIG. 2.

The collar band 230 may be coupled between the trunk part 100 and the upper collar 210 and may include the second collar seam 202 coupled to the neck circumference seam 110 of the trunk part 100 and a collar band seam 240 coupled to the upper collar 210. When the collar band. 230 is coupled to the upper collar 210, the second collar seam 202 may be connected to the first collar seam 201 of the upper collar 210 and may be coupled to the neck circumference seam 110. The collar band seam 240 may be a seam in which the collar band 230 is coupled to the upper collar 210, may be formed along an upper end of the collar band 230, and may be formed to correspond to the neck circumference of the wearer. The second collar seam 202 and the collar band seam 240 will be described in detail with reference to FIG. 2.

FIG. 2 is an exploded view showing the configuration of a collar of a garment according to an embodiment of the present invention and shows a right collar when a wearer wears the garment. FIGS. 3A to 3D are process diagrams showing a coupling procedure of a collar of a garment according to an embodiment of the present invention. FIG. 2 shows the state in which the upper collar extends to the right and a right piece of fabric of the collar band spreads from the center of the cervical vertebrae of the wearer. FIGS. 3A to 3D show a coupling procedure of respective right pieces of fabric of an upper collar and a collar band. A method of coupling the upper collar and the collar band in the garment will be clearly described with reference to the drawings with FIG. 1.

Referring to FIG. 2, the upper collar 210 and the collar band 230 of the collar 200 according to an embodiment of the present invention may be formed in different shapes. That is, the upper collar 210 and the collar band 230 may be formed in shapes that do not correspond to each other when pieces of fabric are unfolded.

The upper collar 210 may be wider and may have a longer overall length than the collar band 230, and the upper end and the lower end of the upper collar 210 may be maintained in a constant width and may be formed to make a steep slope starting from a second point P2. Accordingly, the upper collar 210 may be bent in an overall "L" shape.

The upper collar 210 may include the first collar seam 201 and the upper collar seam 220. The upper collar seam 220 may include a first straight portion 221 formed in a straight line and a first curved portion 222 formed in a curve when the fabric is spread out on a plane.

The first collar seam 201 may be formed at a lower end portion of the upper collar 210, may be spaced apart from the first straight, portion. 221, and may be connected to the first curved portion 222, and the first collar seam 201 may be coupled to the neck circumference seam 110 of the trunk part 100.

The upper collar seam 220 may be a seam in which the upper collar 210 is coupled to the collar band 230, may be formed along a lower end of the upper collar 210, and may be formed to correspond to the neck circumference of the wearer.

The first straight portion 221 may correspond to the back of the neck of the wearer, and may extend from the center of the cervical vertebrae of the back of the neck of the wearer to a central point of a side surface of the neck along the neck of the wearer. An extension start point and an extension end point of the first straight portion 221 may be indicated by a third point P3 and the second point P2 in FIGS. 1 to 3D. That is, the first straight portion 221 may be formed up to the second point P2 from the third point P3 of the upper collar 210.

The first straight portion 221 may be formed in parallel to the second collar seam 202 of the collar band 230.

The first curved portion 222 may correspond to the front of the neck of the wearer and may extend along the neck from a central point of a side surface of the neck of the wearer to the front of the clavicle of the wearer. An extension start point and an extension end point of the first curved portion 222 may be indicated by the second point P2 and a first point P1 in FIGS. 1 to 3D. That is, the first curved portion 222 may be formed up to the first point P1 from the second point P2 of the upper collar 210.

The first curved portion 222 may be formed in a curve from. the second point. P2 to the first point P1, which is a point connected to the first collar seam 201.

The collar band 230 may be narrower and may have a shorter overall length than the upper collar 210, and the upper end and the lower end of the collar band 230 may be maintained in a constant width like the upper collar 210 but may be formed to make a gentle slope starting from a fifth point P5 compared with the upper collar 210.

As described above, the collar band 230 may include the second collar seam. 202 and the collar band seam 240. The collar band seam 240 may include a second straight portion 241 formed in a straight line and a second curved portion 242 formed in a curve when the fabric is spread out on a plane.

The second collar seam 202 may form the neck line and may correspond to a lower end of the collar band 230. The second collar seam 202 may configure a base line of the collar band 230 and may be in parallel to the second straight portion 241, the second curved portion 242 may be connected to the second collar seam 202, and the second collar seam 202 may be coupled to the neck circumference seam 110 of the trunk part 100 and may be formed in an arc shape to correspond to the neck circumference of the wearer.

The collar band seam 240 may be a seam in which the collar band 230 is coupled to the upper collar 210 and may be formed to correspond to the upper end of the collar band 230 and to correspond to the neck circumference of the wearer.

The second straight portion 241 may correspond to the back of the neck of the wearer, and may extend from the center of the cervical vertebrae of the back of the neck of the wearer to a central point of a side surface of the neck along the neck of the wearer. An extension start point and an extension end point of the second straight portion 241 may be indicated by a sixth point P6 and the fifth point P5 in FIGS. 1 to 3D. That is, the second straight portion 241 may be formed up to the fifth point P5 from the sixth point P6 of the collar band 230.

The second straight portion 241 may be formed in parallel to the second collar seam 202.

The second curved portion 242 may correspond to the front of the neck of the wearer and may extend along the neck from a central point of a side surface of the neck of the wearer to the front of the clavicle of the wearer. An extension start point and an extension end point, of the second curved portion 242 may be indicated by the fifth point P5 and a fourth point P4 in FIGS. 1 to 3D. That is, the second curved portion 242 may be formed up to the fourth point P4 from the fifth point P5 of the collar band 230.

The second curved portion 242 may be formed in curve from the fifth point P5 to the fourth point P4, which is a point connected to the second collar seam 202.

According to an embodiment of the present invention, the first curved portion 222 of the upper collar 210 and the second curved portion 242 of the collar band 230 may have different curvatures. For example, a curvature of the first curved port on 222 may be larger than a curvature of the second curved portion 242. The curvatures will be described below with reference to the coupling procedure shown in FIGS. 3A to 3D.

Vertical widths of the upper collar 210 and the collar band 230 may be maintained in a ratio of 1.5:1, and when the fabric is spread out on a plane, the horizontal length of the upper collar 210 and the collar band 230 may be the same as the length of the collar band 230 and the upper collar 210 to a midpoint of the first collar seam 201. That is, a length to the fourth point 34 from the sixth point P6 of the collar band 230 may be the same as a length to a midpoint of the first collar seam 201 from the third point 33 of the upper collar 210.

The total length of left and right parts of the collar band 230 may approximate the neck circumference of the wearer. However, the present. invention is not limited thereto, and the total length of left and right parts of the collar band 230 may be configured in various ways depending on a design of the collar 200.

MODE FOR INVENTION

Referring FIGS. 3A to 3D, the upper collar 210 according to an embodiment of the present invention may be coupled to and may correspond to the collar band 230.

In detail, the first straight portion 221 of the upper collar 210 may be coupled to and may correspond to the second straight portion 241 of the collar band 230, and the first curved portion 222 of the upper collar 210 may be coupled to and may correspond to the second curved portion 242 of the collar band 230.

FIG. 3A is a process diagram showing the state before the upper collar 210 and the collar band 230 are coupled to each other. As described above, the upper collar 210 and the collar band 230 may have different shapes, and the first curved portion 222 of the upper collar 210 and the second curved portion 242 of the collar band 230 may have different curvatures. That is, a portion from the first point P1 to the second point P2 and a portion from the fourth point P4 to the fifth point P5 may have different curvatures.

For example, a curvature of the first curved portion 222 is greater than a curvature of the second curved portion 242. The curvature of the first curved portion 222 is different from a curvature of the second curved portion 242, and thus, when the upper collar 210 and the collar band 230 are coupled to each other, the shape of the upper collar 210 may be stably maintained, which will be described below in more detail with reference to FIG. 1.

According to the present invention, the curvatures of the first curved portion 222 and the second curved portion 242 may be selected in consideration of the size of the body such as the neck of the wearer or a body type, and is not particularly limited. The curvatures of the first curved portion 222 and the second curved portion 242 may be appropriately selected under the condition in which the collar 200 formed by coupling the upper collar 210 and the collar band 230 to each other to stably surround the neck of the wearer and the shape of the collar 200 is stably maintained even if the shape of the collar 200 is changed.

FIG. 3B is a process diagram showing the state in which the first straight portion 221 and the second straight portion 241 of the upper collar 210 and the collar band 230 are coupled to each other.

The first straight portion 221 and the second straight portion 241 of the upper collar 210 and the collar band 230 may be coupled to and may correspond to each other. In detail, the extension. start point of the first straight portion 221 and the extension start point of the second straight portion 241 may correspond to each other, and the extension end point of the first straight portion 221 and extension end point of the second straight portion 241 may also correspond to each other. That is, the third point P3 and the sixth point P6 may correspond to each other, and the second point P2 and the fifth point P5 may correspond. to each other. As the first straight portion 221 and the second straight portion 241 correspond to each other, the upper collar 210 and the collar band 230 may be connected without crumpling or folding on a plane.

The first curved portion 222 and the second curved Portion 242 have different curvatures, and thus, as shown in FIG. 3B, a part of the fabric of the collar band 230 may be overlapped with a part of the fabric of the upper collar 210. That is, the first straight portion 221 and the second straight portion 241 may be coupled to each other along a path from the third point P3 (or the sixth point P6) to the second point P2 (or the fifth point P5), the first curved portion 222 may extend toward the first point P1 from the second point P2, and the second curved portion 242 may extend toward the fourth point P4 from the fifth point P5, and thus extension end point of the second curved portion 242 and the extension end point of the first curved portion 222 may not intersect.

In the state in which the first straight portion 221 and the second straight portion 241 are coupled to each other, a height to the upper end of the upper collar 210 from the second collar seam 202 may correspond to the height of the neck of the wearer when the collar 200 is positioned upright.

FIG. 3C is a process diagram showing a procedure in which the first curved portion 222 and the second curved portion 242 are coupled to each other in the state in which the first straight portion 221 and the second straight portion 241 of the upper collar 210 and the collar band 230 are coupled to each other.

Referring to FIG. 3C, the first curved portion 222 and the second curved portion 242 may be coupled to and may correspond to each other. However, the first curved portion 222 and the second curved portion 242 may have different curvatures, and thus the upper collar 210 or the collar band 230 may not be coupled without folding or crumpling. That is, any one of the first curved portion 222 and the second curved portion 242 needs to be three-dimensionally coupled to the other one in the state of being spaced apart from the ground or being positioned upright. For example, in the state in which the fabric of the upper collar 210 is spread on the ground, the second curved portion 242 of the collar band 230 may be coupled to the first curved portion 222 while the fabric of the collar band 230 is slightly raised from the ground.

In other words, when the first curved portion 222 is coupled to and corresponds to the second curved portion 242, the collar band 230 may be bent inward in the state in which the collar band 230 is positioned upright, and thus the first curved portion 242 of the upper collar 210 may be coupled to the second curved portion 242 by being pulled in an inward direction in which the collar band 230 is bent. That is, the first curved portion 222 may be coupled to the second curved portion 242 by pulling the first point P1 toward the fourth point P4.

FIG. 3D is a process diagram showing the state in which the first straight portion 221 and the second straight portion 241 of the upper collar 210 and the collar band 230 are coupled to each other and the first curved portion 222 and the second curved portion 242 are coupled.

Referring to FIG. 3D, the first curved portion 222 of the upper collar 210 and the second curved portion 242 of the collar band 230 may be coupled to and may correspond to each other despite different curvatures. In this case, the extension start point of the first curved portion 222 and the extension start point of the second curved portion 242 may correspond to each other, and the extension end point of the first curved portion 222 and the extension end point of the second curved portion 242 may also correspond to each. other. That is, the second point P2 and the fifth point P5 may correspond to each other, and the first point P1 and the fourth point P4 may also correspond to each other. As the first curved portion 222 and the second curved portion 242 correspond to each other, at least one of the upper collar 210 or the collar band 230 may be three-dimensionally coupled to each other in the state of being spaced apart from the ground.

As described above, a curvature of the first curved portion 222 of the upper collar 210 is different from a curvature of the second curved portion 242 of the collar band 230, but the first curved portion 222 of the upper collar 210 may be coupled. to and may correspond to the second curved portion 242 of the collar band 230. Thus, the upper collar 210 and the collar band. 230 may be three-dimensionally coupled to each other, and as shown in FIG. 1, the upper collar seam 220 of the upper collar 210 and the collar band seam. 240 of the collar band 230 may be smoothly bent in an arc shape corresponding to the neck circumference of the wearer.

In this case, the upper collar seam 220 and the collar band seam 240 may be formed in the same arc shape as the neck circumference seam 110 of the trunk part 100.

A portion of the upper end. of the upper collar 210, which corresponds to the front of the neck, may be formed in a wider arc shape than portions of the upper collar seam 220 and the collar band seam 240, which correspond to the front of the neck. That is, as the upper collar seam 220 of the upper collar 210 is coupled onto the collar band seam 240 of the collar band 230, the upper collar 210 may be gradually formed obliquely upward as the height of the upper collar 210 increases.

FIG. 4 is a perspective view showing the state in which a collar of a garment is used according to an embodiment of the present invention and showing the state in which the shape of the collar is changed to position the collar upright or to lay the collar flat.

Referring to FIG. 4, the garment 10 according to an embodiment of the present invention may be configured to change the shape of the collar 200. In detail, when the collar 200 is positioned upright, the collar 200 may be transformed into a stand collar form, and when the collar 200 is laid flat, the collar 200 may be transformed into a down collar form.

As described above, the collar 200 may be formed by coupling the upper collar 210 and. the collar band 230, and the first curved portion 222 of the upper collar 210 and the second curved portion 242 of the collar band 230 may have different curvatures and may be coupled to each other. For example, the first curved portion 222 may have a higher curvature than the second curved portion 242 and may be coupled to and may correspond to the second curved portion 242, and thus the shape of the upper collar 210 may be stably maintained even if the upper collar 210 is positioned upright or is laid flat.

FIG. 4A shows the garment 10 in the state in which the collar 200 is positioned upright and FIG. 4B shows the garment 10 in the state in which the collar 200 is folded and is laid flat.

The collar band 230 may be coupled to the neck circumference seam 110 of the trunk part 100, may always be maintained to be positioned upright while being maintained in a Chinese collar (i.e., a stand collar) due to a constant width, and the upper collar 210 is coupled to the collar band 230 to be supported thereby, and accordingly, all of the neck circumference seam 110, the first collar seam 201, the second collar seam 202, the upper collar seam 220, and the collar band seam 240 may be maintained in the same arc shape.

When the collar 200 is positioned upright, the upper end of the upper collar 210 may have a wider arc shape than the neck circumference seam 110, the first collar seam 201, the second collar seam 202, the upper collar seam 220, and the collar band seam 240, and although the upper collar 210 tends to deviate outwardly, the collar band 230 may pull the upper collar 210 inward and may not lie down, and the state in which the collar 200 is in close contact with the neck of the wearer and is positioned upright may be stably maintained. That is, even if there is no separate coupling element, the garment 10 may be changed and. maintained in a stand collar form.

As shown in FIG. 4B, the collar 200 may be laid flat by horizontally folding the upper collar 210 and the collar band 230 at a midpoint of the height thereof to lay the collar 200 flat. In this case, since the upper end of the upper collar 210 is positioned toward a lower portion of the neck of the wearer, there is no concern that the upper collar 210 deviates outwardly, and thus the shape of the collar 200 may be stably maintained, and since the neck line is maintained in an arc shape even if the collar 200 is folded, the collar 200 may not be spaced apart from the neck circumference of the wearer, and thus, the collar 200 may be changed to a down collar form and may be maintained.

As described above, the garment 10 according to an embodiment of the present invention may include the collar 200 having the first curved portion 222 and the second curved portion 242 that have different curvatures, and when the collar 200 is modified, is positioned upright, or is laid flat, the shape of the collar 200 may also be stably maintained. Thus, the wearer may freely configure the collar 200 in a stand collar form or in a down collar form. Thus, a design of the garment 10 may be changed, and thus the outer appearance of the garment 10 may look gorgeous. Even if the collar 200 is configured in a stand collar form, the height of the collar 200 may correspond to the height of the neck of the wearer, and thus, the collar 200 may not touch the jawline of the wearer and may prevent a user from feeling discomfort when wearing the garment 10.

The second curved portion 242 of the collar band 230 may pull and may be coupled to the first curved portion 222 of the upper collar 210 having a different curvature, and thus the collar 200 may be stably maintained in an arc shape irrespective of the shape of the collar 200. Thus, irrespective of the shape of the collar 200, the collar 200 may be in close contact with the neck of the wearer to maintain an exposure degree of the neck, and even if the collar 200 is changed to a stand collar form or a down collar form, an effective and excellent cold protection function may be provided by stably surrounding the neck of the wearer.

In the case of a fur garment manufactured using expensive fabric, when the fur garment is fabricated using the aforementioned method, the overall length of the neck circumference seam 110 may be shorter than a conventional fur garment. Considering that the shape of the collar 200 and the neck line are formed by coupling the collar 200 to a path along the neck circumference seam 110, when the collar 200 is fabricated using the aforementioned method, the amount of fabric consumed is reduced compared to the conventional fur garment, and thus an effect of reducing the production cost may be achieved. Even if the conventional fur garment is fabricated in such a way that the neck circumference seam 110 corresponds to a wearer without improvement of the configuration of the collar 200, the aforementioned effect according to the present invention may not be provided.

The above description of the present invention is for illustration, and those of ordinary skill in the art to which the present invention pertains will understand that the embodiments of the present invention are changed to other specific forms without changing the technical spirit or essential features of the present invention. You will understand. Accordingly, it should be understood that the aforementioned embodiments are illustrative in all respects and not restrictive. For example, each component described as a single type may be implemented in a. distributed form, and components described as distributed may be implemented in a combined form.

The scope of the present invention is defined by the claims described below rather than the above detailed description, and all changes or modifications derived from the meaning and scope of the claims and their equivalents are included in the scope of the present invention.

INDUSTRIAL APPLICABILITY

A garment according to the present invention may be applied to a garment industry. In detail, the garment according to the present invention may be fabricated by processing animal hides, and thus, the garment made according to the present invention may be widely used in cold countries or regions.

The invention claimed is:

1. A garment having a shape-transformable collar comprising:

a trunk part for surrounding a body of a wearer; and a collar coupled to the trunk part along a neck circumference seam of the trunk part, wherein the collar includes: an upper collar formed by coupling a plurality of fabric pieces and forming an outer appearance of the collar; and a collar band coupled between the upper collar and the trunk part, wherein the upper collar includes: a first straight portion corresponding to a back of a neck of the wearer; and a first curved portion corresponding to a front of the neck of the wearer and connected to the first straight portion, wherein the collar band includes: a second straight portion of the back of the neck of the wearer; and a second curved portion corresponding to the front of the neck of the wearer and connected to the second straight portion, and wherein the first straight portion and the second straight portion are coupled to and correspond to each other, the first curved portion and the second curved portion have different curvatures and are coupled to and correspond to each other, the first curved portion has a higher curvature than the second curved portion, and when the upper collar is positioned upright, the upper collar is maintained in an upright state by coupling the first curved portion and the second curved portion.

2. The garment having a shape-transformable collar of claim 1, wherein the collar band is always maintained in the upright state along a neck circumference of the wearer, has a constant width up to a starting point of the second curved portion, and is maintained in a Chinese collar form.

3. The garment having a shape-transformable collar claim 1, wherein the collar is coupled to the trunk part along the neck circumference seam of the trunk part, the upper collar includes a first collar seam spaced apart from the first straight portion and connected to the first curved portion, the collar band includes a second collar seam positioned in parallel to the second straight portion, connected to the second curved portion, and constituting a base line of the collar band, and when the upper collar and the collar band are coupled to each other, the first collar seam and the second collar seam are connected to each other and are coupled to the trunk part along the first collar seam and the second collar seam.

4. The garment having a shape-transformable collar of claim 3, wherein the first collar seam and the second collar seam are formed. in an arc shape to correspond to a neck. circumference of the wearer.

5. The garment having a shape-transformable collar of claim 3, wherein a height of the collar to an upper end of the upper collar from. the second collar seam corresponds to a height of the neck of the wearer.

* * * * *